US008008862B2

(12) United States Patent
Malkmus

(10) Patent No.: US 8,008,862 B2
(45) Date of Patent: Aug. 30, 2011

(54) SHINE-THROUGH HYDROGEN LAMP

(75) Inventor: Rolf Malkmus, Hanau (DE)

(73) Assignee: Heraeus Noblelight GmbH, Hanau (DE)

( * ) Notice: Subject to any disclaimer, the term of this patent is extended or adjusted under 35 U.S.C. 154(b) by 150 days.

(21) Appl. No.: 12/439,305

(22) PCT Filed: Aug. 29, 2007

(86) PCT No.: PCT/EP2007/007535

§ 371 (c)(1),
(2), (4) Date: Feb. 27, 2009

(87) PCT Pub. No.: WO2008/025523

PCT Pub. Date: Mar. 6, 2008

(65) Prior Publication Data

US 2010/0013390 A1 Jan. 21, 2010

(30) Foreign Application Priority Data

Aug. 30, 2006 (DE) ..... 10 2006 040 613

(51) Int. Cl.
*H01J 17/00* (2006.01)
*H01J 61/12* (2006.01)
*H01J 17/20* (2006.01)

(52) U.S. Cl. ..... 313/609; 313/613; 313/611; 313/238; 313/637

(58) Field of Classification Search ..... 313/637, 313/238–242, 609–616
See application file for complete search history.

(56) References Cited

U.S. PATENT DOCUMENTS

| | | | | |
|---|---|---|---|---|
| 4,910,431 | A | 3/1990 | Witt et al. | |
| 5,886,470 | A | 3/1999 | Smolka | |
| 5,972,469 | A | 10/1999 | Curtis | |
| 6,586,866 | B1 | 7/2003 | Ikedo et al. | |
| 6,690,111 | B1 * | 2/2004 | Davenport | 313/613 |
| 6,870,317 | B2 | 3/2005 | Ito et al. | |
| 2002/0017876 | A1 | 2/2002 | Herter | |
| 2008/0246400 | A1 * | 10/2008 | Ito et al. | 313/609 |

FOREIGN PATENT DOCUMENTS

| | | | |
|---|---|---|---|
| DE | 37 15 375 | C1 | 10/1988 |
| DE | 37 13 704 | A1 | 11/1988 |
| DE | 39 08 553 | C1 | 4/1990 |
| DE | 41 20 730 | A1 | 1/1993 |
| DE | 199 02 808 | A1 | 8/1999 |
| DE | 199 20 579 | A1 | 11/2000 |
| DE | 196 28 925 | B4 | 7/2004 |
| EP | 0 685 874 | A1 | 12/1995 |
| EP | 1 437 760 | A1 | 7/2004 |
| GB | 2 257 562 | A | 1/1993 |
| JP | 04341750 | A * | 11/1992 |
| JP | 07006737 | A * | 1/1995 |
| WO | 02/063649 | A2 | 8/2002 |

OTHER PUBLICATIONS

Heike; "Shine Through Deuterium Lamps Offering Wide Wavelength range in Spectroscopy"; [Online] Oct. 15, 1999; Heraeus Noblelight GmbH; Germany; Retreived from the internet: URL:http://web.archive.org/web/20060923184509/www.noblelight.net/products/resources/pDF_central/other_products/deut04.pdf>.

* cited by examiner

*Primary Examiner* — Mariceli Santiago
(74) *Attorney, Agent, or Firm* — Panitch Schwarze Belisario & Nadel LLP

(57) ABSTRACT

A shine-through, low pressure discharge, hydrogen lamp has a metallic housing structure shielding the discharge space in a lamp bulb filled with hydrogen. In this lamp a diaphragm (4) made of electrically insulating material is fixed in the metallic housing part (2) which is to face a visible light source.

7 Claims, 2 Drawing Sheets

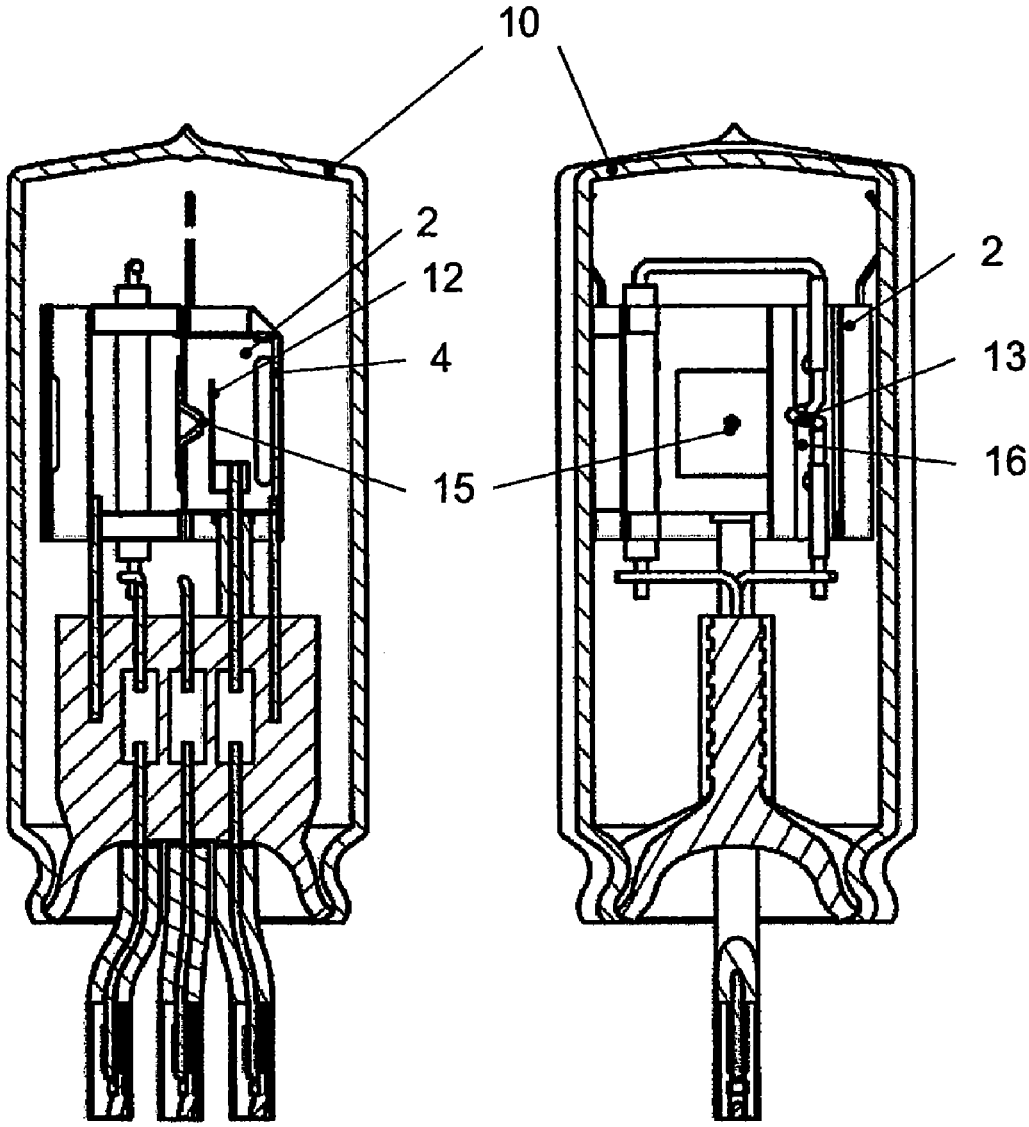
Fig. 4
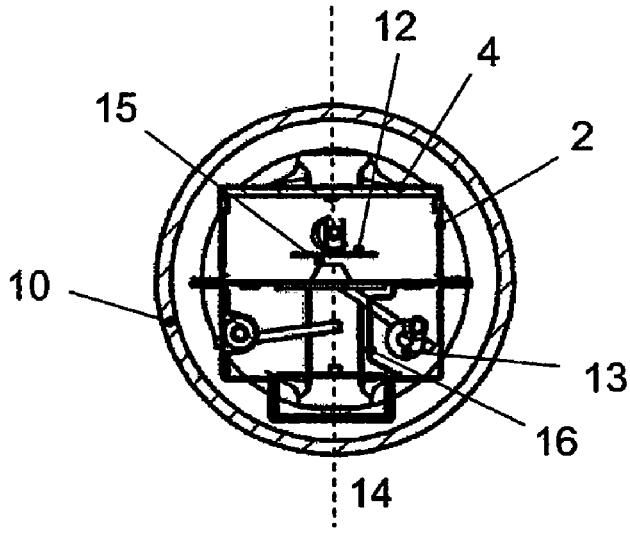

SHINE-THROUGH HYDROGEN LAMP

CROSS-REFERENCE TO RELATED APPLICATIONS

This application is a Section 371 of International Application No. PCT/EP2007/007535, filed Aug. 29, 2007, which was published in the German language on Mar. 6, 2008, under International Publication No. WO 2008/025523 A1 and the disclosure of which is incorporated herein by reference.

BACKGROUND OF THE INVENTION

The invention relates to a shine-through lamp having a discharge chamber defined by a metal housing structure inside a closed lamp bulb and to its use in chemical analysis, in particular in combination with a VIS lamp.

These shine-through lamps lose their shine-through properties due to metal deposits in the lamp bulb in the region in front of the passage opening for visible light.

According to German published patent application DE 199 20 579 A1, in a known UV discharge lamp inside a discharge chamber containing a filling gas, electrodes are spaced apart from each other with a quartz disk. By means of boreholes in the electrodes, which overlap in a projection in the main irradiation direction, a shine-through lamp is created. In this way, a halogen lamp is arranged behind the deuterium lamp, such that its light passes through the two boreholes of the deuterium lamp electrodes, and the continuous UV spectrum of the deuterium lamp is expanded in the visible spectral range.

According to German Patent DE 196 28 925 B4, for increasing the usable radiation density, several diaphragms made of a high melting point material are arranged in a hydrogen discharge lamp, wherein diaphragms made of a high melting point ceramic are provided with an electrically conductive coating.

U.S. Pat. No. 6,870,317 B2 uses ceramic parts that limit the discharge in a gas discharge tube.

The commercially available shine-through lamps described according to the Heraeus brochure "Shine through deuterium lamps offering wide wavelength range in spectroscopy" have a metallic, open shield housing structure. This shield housing structure comprises several chambers in a box structure.

According to German published patent application DE 41 20 730 A1, a low pressure discharge lamp constructed as a shine-through lamp can also be constructed without electrodes.

European patent application publication no. EP 0 685 874 A1 discloses a deuterium discharge tube, in which the shield box structure has a discharge shielding plate and a support plate made of ceramic and a metallic front cover made of aluminum, which is mounted in front of the discharge shielding plate. The support plate has a convex cross section and a passage hole formed perpendicular to the support plate at its rear section. Metal pins are inserted into passage holes of the shielding plate and the support plate. Deposits of evaporated electrode material can lead to short circuits, which is why preventative measures are taken against these deposits.

BRIEF SUMMARY OF THE INVENTION

It is an object of the present invention is to provide a shine-through lamp having a metallic shielding box, which prevents deposits in front of the passage opening and which does not have the disadvantages of other low pressure discharge lamps. In particular, it is not constructed without electrodes or exposed to the problems of short circuits due to evaporated electrode material.

According to the invention, it was recognized that for achieving the object only the border strip of the metallic housing or shielding box or the diaphragm opening created for an additional VIS light source must be made of electrically insulating material.

The diaphragm provided according to one embodiment of the invention is made of an electrically insulating material, in particular a ceramic or a glass or a glass ceramic. As the diaphragm material, oxide ceramics have proven effective, in particular aluminum oxide.

The diaphragm is fixed on the back side of the open metallic housing, in particular without adhesive. For the sake of simplicity, the side designated as the back side is the side opposite the light discharge opening, which is provided for the additional feeding of VIS radiation of another radiation source. This back side advantageously has a mount for fixing the diaphragm. Thus, an electrically insulating diaphragm for the incident visible light is provided on the side of the metallic housing structure or the shielding box structure facing the visible light source. Other electrically insulating housing structure or box structure regions are not required according to the invention. In particular, according to the invention there should be no ceramic structures, which are susceptible to deposits of evaporated electrode material and which therefore could lead to short circuits.

The shine-through lamp according to one embodiment of the invention is a low pressure discharge lamp having hydrogen, in particular deuterium, as the filling gas in a lamp bulb made of quartz glass or high silicate glass, in particular borosilicate glass having a maximum of 30 wt. % $B_2O_3$, with a housing arranged therein, which contains an anode and a cathode. Between the two electrodes is located at least one diaphragm body made of a high melting point material and having a diaphragm opening for necking of the arc discharge generated between the electrodes. The cathode lies outside of the axis of a beam path emerging from the diaphragm. On the back side (side opposite the light discharge opening) there is an open metallic housing, which serves as a mount for a non-conductive diaphragm, advantageously made of oxide ceramic. It features a continuous UV spectrum, whereby it is suitable for analytical purposes. For supplementing the continuous UV spectrum with a continuous VIS spectrum, for example a halogen emitter, a VIS inlet opening is necessary, which is constructed according to the invention as an electrically insulating, in particular ceramic, diaphragm.

As the material for the metallic housing, nickel or stainless steel has proven effective. The metallic back side is constructed as a holder, in particular a mount, for the non-metallic diaphragm.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 4 is a section of a shine-through lamp according to an embodiment of the invention.

DETAILED DESCRIPTION OF THE INVENTION

Figure 2:
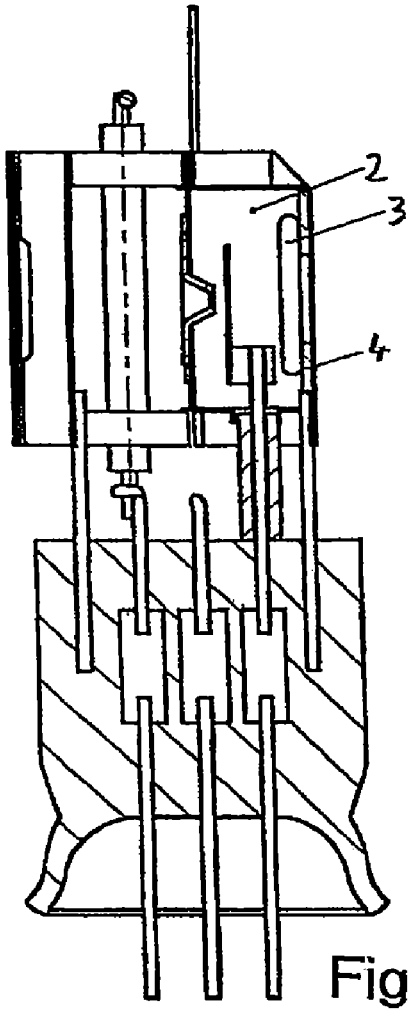
FIG. 2 is a section through the shield housing structure and the current feedthrough of the shine-through lamp.

According to FIG. 4, the housing 11 accommodated in a lamp bulb 10 made of quartz glass has a plate-shaped anode 12 and a heatable cathode 13. Directly in front of the anode 12, in the direction of the axis 14 of the light discharge direction, there is a diaphragm 15 made of a high melting point material, for example molybdenum, which realizes a necking of the discharge arc between the anode 12 and cathode 13 for increasing the intensity.

Directly in front of the cathode 13 there is a shielding plate 16. The cathode 13 is arranged in a lateral region, in order to allow a free beam discharge along the axis 14.

In the deuterium lamp according to FIG. 4, a nickel housing 2 with a diaphragm 4 made of aluminum oxide is arranged inside a cylindrical, closed lamp bulb 10 made of quartz glass. In the nickel housing 2 an anode, a cathode, and a focusing electrode are arranged. The nickel housing is open and surrounded on the inside and the outside by deuterium contained in the lamp bulb 10. The electrodes are arranged in a typical manner for deuterium lamps with shielding boxes, likewise their current feed.

Figure 3:
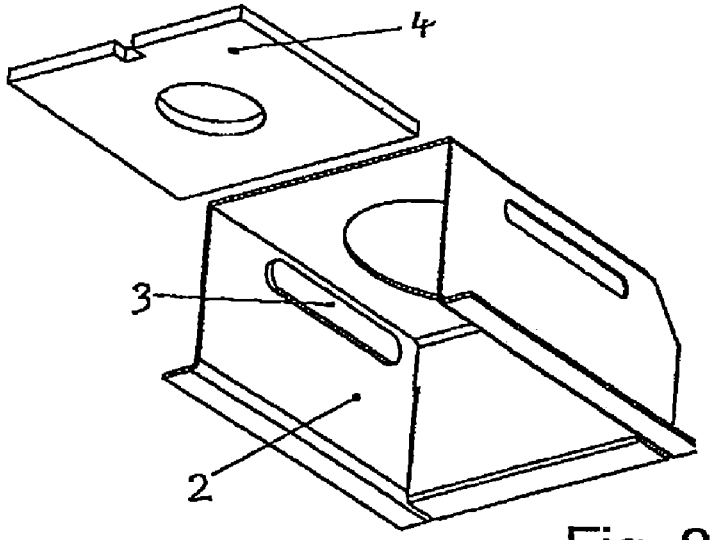
FIG. 3 is a mount according to an embodiment of the invention on the back side of the metal housing and a diaphragm fitted thereto.
Figure 1:
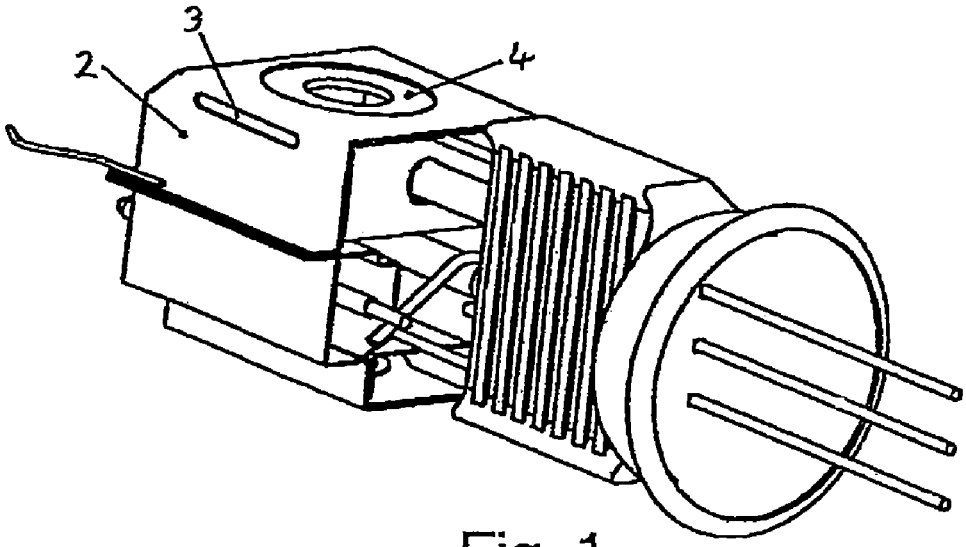
FIG. 1 is a perspective representation of a shield housing structure, which is fixed on a current feedthrough.

FIG. 3 shows, in a perspective diagram, the rear-side part of the shield housing structure and a ceramic diaphragm adapted thereto. A deuterium lamp contains a shield housing structure made of nickel inside a cylindrical, closed lamp bulb made of quartz glass. Its rear-side part 2 has a mount constructed in the form of beads 3. A diaphragm 4 is guided and held by the beads 3 of the mount. The beads 3 of the mount are generated by an embossing technique, so that the material plane displaced by the embossing produces a rail for guiding the diaphragm.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A shine-through, low pressure discharge, hydrogen lamp comprising a metallic housing having a front side and a back side and shielding a discharge chamber in a lamp bulb filled with hydrogen, a light discharge opening formed in the front side of the metallic housing, and a diaphragm made of electrically insulating material fixed in the metallic housing, the diaphragm being on the back side of the metallic housing opposite the light discharge opening, and facing a visible light source.

2. The shine-through lamp according to claim 1, wherein the electrically insulating diaphragm is fixed on the metallic housing without adhesive.

3. The shine-through lamp according to claim 2, wherein the electrically insulating diaphragm is held in a mount on the back side of the metallic housing.

4. The shine-through lamp according to claim 1, wherein the hydrogen is deuterium.

5. A method for spectral analysis comprising using the shine-through lamp according to claim 1 to perform the spectral analysis.

6. The method according to claim 5, wherein spectral analysis is carried out in a spectrometer.

7. The method according to claim 5, wherein the shine-through lamp is applied in the analysis in combination with a VIS lamp.

* * * * *